US010316276B2

(12) United States Patent
Hellmuth et al.

(10) Patent No.: US 10,316,276 B2
(45) Date of Patent: Jun. 11, 2019

(54) DETERGENTS AND CLEANING PRODUCTS INCLUDING A POLYMER ACTIVE INGREDIENT

(71) Applicants: Henkel AG & Co. KGaA, Duesseldorf (DE); Fraunhofer Gesellschaft zur Foerderung der angewandten Forschung e.V., Munich (DE)

(72) Inventors: Hendrik Hellmuth, Darmstadt (DE); Benoit Luneau, Ratingen (DE); Nicole Bode, Duesseldorf (DE); Alexander Schulz, Duesseldorf (DE); Andreas Buhl, Langenfeld (DE); Yvonne Willemsen, Korschenbroich (DE); Andre Laschewsky, Potsdam (DE); Erik Wischerhoff, Potsdam (DE); Michael Paech, Potsdam (DE)

(73) Assignees: Henkel AG & Co. KGaA (DE); Faunhofer Gesellschaft zur Förderung der angewandten Forschung e.V. (DE)

( * ) Notice: Subject to any disclaimer, the term of this patent is extended or adjusted under 35 U.S.C. 154(b) by 0 days.

(21) Appl. No.: 15/614,353

(22) Filed: Jun. 5, 2017

(65) Prior Publication Data

US 2017/0267953 A1 Sep. 21, 2017

Related U.S. Application Data

(63) Continuation of application No. PCT/EP2015/077418, filed on Nov. 24, 2015.

(30) Foreign Application Priority Data

Dec. 5, 2014 (DE) ..... 10 2014 017 964

(51) Int. Cl.

| | |
|---|---|
| ***C11D 1/48*** | (2006.01) |
| ***C11D 3/28*** | (2006.01) |
| ***C11D 3/37*** | (2006.01) |
| ***C11D 9/22*** | (2006.01) |
| ***C11D 7/14*** | (2006.01) |
| ***C11D 7/26*** | (2006.01) |
| ***C11D 9/30*** | (2006.01) |
| ***C11D 11/04*** | (2006.01) |
| *C11D 3/386* | (2006.01) |
| *C11D 11/00* | (2006.01) |
| *C11D 11/02* | (2006.01) |
| *C11D 13/10* | (2006.01) |

(52) U.S. Cl.

CPC ..... *C11D 9/225* (2013.01); *C11D 1/48* (2013.01); *C11D 3/28* (2013.01); *C11D 3/3796* (2013.01); *C11D 7/14* (2013.01); *C11D 7/265* (2013.01); *C11D 9/30* (2013.01); *C11D 11/04* (2013.01); *C11D 3/38663* (2013.01); *C11D 11/0017* (2013.01); *C11D 11/0023* (2013.01); *C11D 11/02* (2013.01); *C11D 13/10* (2013.01)

(58) Field of Classification Search

CPC ..... C11D 1/48; C11D 3/28; C11D 3/3769; C11D 3/3796; C11D 9/225

See application file for complete search history.

(56) References Cited

U.S. PATENT DOCUMENTS

| | | | | |
|---|---|---|---|---|
| 4,664,839 | A | 5/1987 | Rieck | |
| 5,512,644 | A | 4/1996 | Ogura et al. | |
| 2007/0244023 | A1 | 10/2007 | Brodt et al. | |
| 2009/0029895 | A1* | 1/2009 | Scialla ..... | C11D 3/3796 510/180 |
| 2009/0301519 | A1 | 12/2009 | Aubay | |

FOREIGN PATENT DOCUMENTS

| | | | |
|---|---|---|---|
| FR | 2813312 | A1 | 3/2002 |
| WO | 0056849 | A1 | 9/2000 |
| WO | 0157171 | A1 | 8/2001 |
| WO | 03054044 | A2 | 7/2003 |
| WO | 03066791 | A1 | 8/2003 |

OTHER PUBLICATIONS

PCT International Search Report (PCT/EP2015/077418) dated Feb. 17, 2016.

* cited by examiner

*Primary Examiner* — Brian P Mruk
(74) *Attorney, Agent, or Firm* — Thomas G. Krivulka

(57) ABSTRACT

The aim of the invention is to improve the primary detergent power of detergents and cleaning products, in particular with respect to soiling containing oil and/or grease. For this purpose, polymers comprising N-vinyl imidazole-derived betaine units are incorporated into the products.

3 Claims, No Drawings

DETERGENTS AND CLEANING PRODUCTS INCLUDING A POLYMER ACTIVE INGREDIENT

FIELD OF THE INVENTION

The present invention generally relates to the use of specific polymers comprising betaine units for improving the primary detergent power of detergents or cleaning products with respect to soiling, in particular soiling containing oil and/or grease, when washing textiles or cleaning hard surfaces, and to detergents and cleaning products which contain such polymers.

BACKGROUND OF THE INVENTION

In addition to the ingredients that are indispensable for the washing process, such as surfactants and builder materials, detergents generally also contain further constituents, which can be summarized under the term washing auxiliaries and which comprise active ingredient groups as diverse as those such as foam regulators, anti-graying agents, bleaching agents, bleach activators, and dye transfer inhibitors. Auxiliaries of this type also include substances of which the presence improves the detergent power of surfactants without themselves generally having to demonstrate a significant surfactant behavior. The same is also true, analogously, for cleaning products for hard surfaces. Substances of this type are often referred to as detergent power boosters or as fat boosters on account of their particularly pronounced effect with respect to oil- or grease-based soiling.

Detergents or rinsing agents which in addition to surfactant also contain copolymers formed of anionic and cationic monomers and optionally additionally non-ionic monomers are known from international patent application WO 0157171 A1.

The color- and shape-retaining effect of cationically charged polymers when washing textiles is known from international patent application WO 0056849 A1.

The soil-release effect of block copolymers formed of ethylenically unsaturated monomers and alkylene oxides, alkylene glycols or cyclic ethers is known from international patent application WO 03054044 A2.

International patent application WO 03066791 A1 describes, on substrate surfaces, associated polymers consisting to an extent of at least 1 mol % of amide group-containing monomers.

Furthermore, other desirable features and characteristics of the present invention will become apparent from the subsequent detailed description of the invention and the appended claims, taken in conjunction with this background of the invention.

BRIEF SUMMARY OF THE INVENTION

The subject of the invention is the use of polymers formed of the units A and B,

A

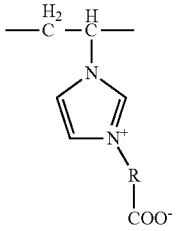

-continued

B

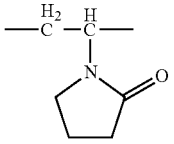

wherein R stands for a double-bond hydrocarbon group having 1 to 6, in particular 1 to 3 carbon atoms, for improving the primary detergent power of detergents or cleaning products with respect to soiling, in particular soiling containing oil and/or grease, when washing textiles or when cleaning hard surfaces.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has surprisingly been found that polymers comprising N-vinyl imidazole-derived betaine units have particularly good properties with regard to improving primary detergent power.

The polymers essential to the invention are obtainable by radical copolymerization of 1-vinyl imidazole with N-vinyl-2-pyrrolidone, which can be carried out as block copolymerization or preferably random copolymerization, and by subsequent reaction of the copolymer thus obtained with haloalkanoic acids, such as chloroacetic acid, or ethylenically unsaturated carboxylic acids, such as acrylic acid or methacrylic acid. Said polymers do not comprise any other units apart from the units A and B, wherein non-quaternized vinyl imidazole groups can be contained at most in an insignificant amount as a result of the production process, and units originating from the radical starter can be present at the polymer ends. The proportion of non-quaternized vinyl imidazole groups is preferably less than 20 mol %, in relation to the sum of quaternized vinyl imidazole groups and non-quaternized vinyl imidazole groups in the polymer.

The units A and B are present in the polymer essential to the invention preferably in molar ratios ranging from 1:99 to 99:1, in particular from 50:50 to 80:20, and particularly preferably of approximately 75:25. The polymer active ingredient preferably has a mean molecular weight (referred to here and hereinafter as the "number average" where mean molecular weights are specified) ranging from 1,000 g/mol to 300,000 g/mol, in particular from 2,000 to 200,000 g/mol.

If a polymer essential to the invention is introduced into water together with linear alkylbenzene sulfonate, an increase in the surface tension in the presence of the polymer is observed in the region of the critical micelle concentration (of approximately 0.1 g/1) compared to the same concentration of the surfactant in the absence of the polymer. Without wishing to be tied to this theory, this leads to the assumption that, with the presence of the polymer, more surfactant is present in the solution and thus less surfactant is present at the water-air interface due to the formation of a cleaning-active surfactant-polymer aggregate, and therefore the surface tension rises. A further subject of the invention is therefore the use of a combination of polymers formed of the aforementioned units A and B and alkylbenzene sulfonate with linear $C_{7-15}$ alkyl groups, in particular linear $C_{9-13}$ alkyl groups, for improving the primary detergent power of detergents or cleaning products with respect to soiling, in particular soiling containing oil and/or grease, when washing textiles or when cleaning hard surfaces. The alkylbenzene sulfonates have counter-cations from the group of alkali metal ions and/or ammonium ions, wherein sodium, potassium $NH_4^+$ and/or $N(R^1)_4^+$ ions with $R^1$=hydrogen, $C_{1-4}$ alkyl and/or $C_{2-4}$ hydroxyalkyl are preferred. In this combination the ratio by weight of linear alkylbenzene sulfonate to polymer essential to the invention lies preferably in the range of from 20:1 to 1:1, in particular from 8:1 to 3:1.

The use of the active ingredient used in accordance with the invention leads to a significantly better removal of soiling, in particular soiling caused by grease and cosmetics, on hard surfaces and on textiles, including those made of cotton or comprising a proportion of cotton, than has previously been the case with use of compounds known for this purpose. Alternatively, significant amounts of surfactants can be saved whilst maintaining the same grease removal capability.

The use according to the invention can be implemented within the scope of a washing or cleaning process in such a way that the polymer essential to the invention is added to a detergent-containing or cleaning product-containing aqueous liquor or is introduced into the liquor preferably as constituent of a detergent or cleaning product, wherein the concentration of the active ingredient in the liquor preferably lies in the range of from 0.01 g/l to 0.5 g/l, in particular from 0.02 g/l to 0.2 g/l.

A further subject of the invention is a method for removing soiling, in particular soiling containing oil and/or grease, from textiles or hard surfaces by contacting the textile or the hard surface with an aqueous liquor, in which a detergent or cleaning product and an aforementioned polymer active ingredient are used. This method can be performed by hand or by machine, for example with the aid of a domestic washing machine or dishwasher. It is possible here that in particular liquid detergent or cleaning product and the active ingredient are used at the same time or in succession. The simultaneous use can be carried out particularly advantageously by the use of a product containing the active ingredient.

A further subject of the invention is therefore a detergent or cleaning product containing a polymer formed of the aforementioned units A and B.

Detergents or cleaning products that contain an active ingredient to be used in accordance with the invention or that are used together therewith or that are used in the method according to the invention can contain all usual other constituents of such products which do not act in an undesirable manner with the active ingredient essential to the invention. An above-defined polymer active ingredient is preferably incorporated in detergents or cleaning products in amounts of from 0.1 wt. % to 10 wt. %, in particular 0.5 wt. % to 2 wt. %.

A product that contains an active ingredient to be used in accordance with the invention or that is used together therewith or that is used in the method according to the invention preferably contains synthetic anionic surfactant of the sulfate and/or sulfonate type, in particular alkylbenzene sulfonate, fatty alkyl sulfate, fatty alkyl ether sulfate, alkyl and/or dialkyl sulfosuccinate, sulfofatty acid esters and/or sulfofatty acid disalts, in particular in an amount ranging from 2 wt. % to 25 wt. %, and particularly preferably from 5 wt. % to 15 wt. %. The anionic surfactant is preferably selected from the alkylbenzene sulfonates, the alkyl or alkenyl sulfates and/or the alkyl or alkenyl ether sulfates, in which the alkyl or alkenyl group has 8 to 22, in particular 12 to 18 C atoms. These are not usually individual substances, but cuts or mixtures. Those of which the proportion of compounds having longer-chain groups ranging from 16 to 18 C atoms is more than 20 wt. % are preferred. The presence of the above-mentioned combination of polymer essential to the invention and alkylbenzene sulfonate with linear $C_{9-13}$ alkyl groups in the products is particularly preferred.

A further embodiment of such products comprises the presence of non-ionic surfactant, selected from fatty alkyl polyglycosides, fatty alkyl polyalkoxylates, in particular ethoxylates and/or propoxylates, fatty acid polyhdroxy amides and/or ethoxylation and/or propoxylation products of fatty alkyl amines, vicinal diols, fatty acid alkyl esters and/or fatty acid amides and mixtures thereof, in particular in an amount ranging from 2 wt. % to 25 wt. %.

Potential non-ionic surfactants include the alkoxylates, in particular the ethoxylates and/or propoxylates of saturated or mono- to polyunsaturated linear or branch-chained alcohols having 10 to 22 C atoms, preferably 12 to 18 C atoms. Here, the degree of alkoxylation of the alcohols is generally between 1 and 20, preferably between 3 and 10. They can be produced in the known manner by reacting the corresponding alcohols with the corresponding alkenyl oxides. In particular, the derivatives of the fatty alcohols are suitable, although the branch-chained isomers thereof, in particular what are known as oxoalcohols, can also be used for the preparation of usable alkoxylates. Accordingly, the alkoxylates, in particular the ethoxylates, of primary alcohols with linear, in particular dodecyl, tetradecyl, hexadecyl or octadecyl groups as well as mixtures thereof can be used. In addition, appropriate alkoxylation products of alkylamines, vicinal diols, and carboxylic acid amides which correspond in terms of the alkyl part to the specified alcohols can be used. In addition, the ethylene oxide and/or propylene oxide insertion products of fatty acid alkyl esters and also fatty acid polyhydroxyamides can be considered. 'Alkyl polyglycosides' suitable for incorporation into the products according to the invention are compounds of general formula $(G)_n$-$OR^{12}$, in which $R^{12}$ means an alkyl or alkenyl group having 8 to 22 C atoms, G means a glucose unit, and n means a number between 1 and 10. The glycoside component $(G)_n$ is composed of oligomers or polymers from naturally occurring aldose or ketose monomers, including in particular glucose, mannose, fructose, galactose, talose, gulose, altrose, allose, idose, ribose, arabinose, xylose and lyxose. The oligomers consisting of glycosidically linked monomers of this type are additionally characterized by the type of sugars contained therein, by the number thereof, and by what is known as the degree of oligomerization. The degree of oligomerization n generally assumes fractional numerical values as a variable that is to be determined analytically; it lies at values between 1 and 10, at which glycosides used with preference are below a value of 1.5, in particular between 1.2 and 1.4. A preferred monomer unit is glucose due to the good availability. The alkyl or alkenyl part $R^{12}$ of the glycosides preferably also originates from easily accessible derivatives of renewable raw materials, in particular from fatty alcohols, although the branch-chained isomers thereof, in particular what are known as oxoalcohols, can also be used for the preparation of usable glycosides. In particular, the primary alcohols with linear octyl, decyl, dodecyl, tetradecyl, hexadecyl or octadecyl groups and also mixtures thereof can be used accordingly. Particularly preferred alkylglycosides contain a coconut oil alkyl group, that is to say mixtures with substantially $R^{12}$=dodecyl and $R^{12}$=tetradecyl.

Non-ionic surfactant is used in products containing an active ingredient used in accordance with the invention or within the scope of the use according to the invention, preferably in amounts of from 1 wt. % to 30 wt. %, in particular from 1 wt. % to 25 wt. %, wherein amounts in the upper part of this range tend to be encountered in liquid detergents, whereas particulate detergents preferably tend to contain lower amounts of up to 5 wt. %.

The products can contain further surfactants instead or additionally, preferably synthetic anionic surfactants of the sulfate or sulfonate type. Besides the alkylbenzene sulfonates already mentioned, the alkyl and/or alkenyl sulfates having 8 to 22 C atoms which carry an alkali-, ammonium- or alkyl- or hydroxyalkyl-substituted ammonium ion as counter-cation can be cited as synthetic anionic surfactants particularly suitable for use in products of this type. The derivatives of the fatty alcohols having in particular 12 to 18 C atoms and the branch-chained analogues thereof, or what as known as the oxoalcohols, are preferred. The akyl and alkenyl sulfates can be produced in the known manner by reacting the corresponding alcohol components with a conventional sulfation reagent, in particular sulfur trioxide or chlorosulfonic acid, and subsequent neutralization with alkali-, ammonium-, or alkyl- or hydroxyalkyl-substituted ammonium bases. The usable surfactants of the sulfate type also include the sulfated alkoxylation products of the specified alcohols, or what are known as ether sulfates. Ether sulfates of this type preferably contain 2 to 30, in particular 4 to 10 ethylene glycol groups per molecule. The suitable anionic surfactants of the sulfonate type include the α-sulfoesters obtainable by reacting fatty acid esters with sulfur trioxide and by subsequent neutralization, in particular the sulfonation products deriving from fatty acids having 8 to 22 C atoms, preferably 12 to 18 C atoms, and linear alcohols having 1 to 6 C atoms, preferably 1 to 4 C atoms, and also the sulfofatty acids arising from these as a result of formal saponification. Preferred anionic surfactants are also the salts of sulfosuccinic acid esters, which are also referred to as alkyl sulfosuccinates or dialkyl sulfosuccinates, and represent the monoesters or diesters of sulfosuccinic acid with alcohols, preferably fatty alcohols, and in particular ethoxylated fatty alcohols. Preferred sulfosuccinates contain $C_8$ to $C_{18}$ fatty alcohol groups or mixtures thereof. Particularly preferred sulfosuccinates contain an ethoxylated fatty alcohol group, which considered per se represents a non-ionic surfactant. Here, sulfosuccinates of which the fatty alcohol groups derive from ethoxylated fatty alcohols with narrowed homolog distribution are in turn particularly preferred.

Soaps can be considered as further optional surfactant ingredients, wherein saturated fatty acid soaps, such as salts of lauric acid, myristic acid, palmitic acid or stearic acid, and also soaps derived from natural fatty acid mixtures, for example coconut, palm kernel or tallow fatty acids, are suitable. In particular, soap mixtures which are composed to an extent of up to 50 wt. % to 100 wt. % of saturated $C_{12}$-$C_{18}$ fatty acid soaps and up to 50 wt. % of oleic acid soaps are preferred. Soap is preferably contained in amounts of from 0.1 wt. % to 5 wt. %. However, higher soap amounts of generally up to 20 wt. % can also be contained in particular in liquid products containing an active ingredient used in accordance with the invention.

If desired, the products can also contain betaine surfactants and/or cationic surfactants, which, if present, are preferably used in amounts of from 0.5 wt. % to 7 wt. %. Among these, the esterquats discussed below are particularly preferred.

The products, if desired, can contain bleaching agents based on peroxygen, in particular in amounts of from 5 wt. % to 70 wt. %, and as appropriate bleach activator, in particular in amounts ranging from 2 wt. % to 10 wt. %. The bleaching agents under consideration are preferably the peroxygen compounds generally used in detergents, such as percarboxylic acids, for example dodecane diperacid or phthaloylaminoperoxicaproic acid, hydrogen peroxide, alkaliperborate, which can be present as tetra- or monohydrate, percarbonate perpyrophosphate and persilicate, which generally are present in the form of alkali salts, in particular in the form of sodium salts. Bleaching agents of this type are contained in detergents containing an active ingredient used in accordance with the invention preferably in amounts of up to 25 wt. %, in particular up to 15 wt. %, and particularly preferably from 5 wt. % to 15 wt. %, in each case in relation to the total agent, wherein percarbonate is used in particular. The optionally present component of the bleach activators comprises the usually used N- or O-acyl compounds, for example multiply acylated alkylene diamines, in particular tetraacetylethylene diamine, acylated glycolurils, in particular tetracetylglycoluril, N-acylated hydantoins, hydracids, triazoles, urazoles, diketopiperazines, sulfuryl amides, and cyanurates, additionally carboxylic acid anhydrides, in particular phthalic acid anhydride, carboxylic acid esters, in particular sodium isononanoyl phenol sulfonate, and acylated sugar derivatives, in particular pentaacetyl glucose, and also cationic nitrile derivatives, such as trimethylammonium acetonitrile salts. The bleach activators may have been coated in the known manner with enveloping substances in order to prevent interaction with the percompounds during storage, and/or may have been granulated, wherein tetraacetylethylenediamine granulated with the aid of carboxymethyl cellulose and having average particle sizes of from 0.01 mm to 0.8 mm, granulated 1,5-diacetyl-2,4-dioxohexahydro-1,3,5-triazine and/or trialkyl ammonium acetonitrile in particle form is particularly preferred. Bleach activators of this type are contained in detergents preferably in amounts of up to 8 wt. %, in particular from 2 wt. % to 6 wt. %, in each case in relation to the total product.

In a further embodiment the product contains water-soluble and/or water-insoluble builder, in particular selected from alkali alumosilicate, crystalline alkali silicate with modulus greater than 1, monomeric polycarboxylate, polymeric polycarboxylate, and mixtures thereof, in particular in amounts ranging from 2.5 wt. % to 60 wt. %.

The product preferably contains 20 wt. % to 55 wt. % of water-soluble and/or water-insoluble, organic and/or inorganic builder. In particular, water-soluble organic builder substances include those from the class of polycarboxylic acids, in particular citric acid and sugar acids, and also the polymeric (poly)carboxylic acids, in particular the polycarboxylates accessible by oxidation of polysaccharides, polymeric acrylic acids, methacrylic acids, maleic acids, and mixed polymers thereof, which can also contain, polymerized therein, small proportions of polymerizable substances without carboxylic acid functionality. The relative molecular mass of the homopolymers of unsaturated carboxylic acids generally lies between 5,000 g/mol and 200,000 g/mol, and that of the copolymers between 2,000 g/mol and 200,000 g/mol, preferably 50,000 g/mol to 120,000 g/mol, in relation to free acid. A particularly preferred acrylic acid-maleic acid copolymer has a relative molecular mass of from 50,000 g/mol to 100,000 g/mol. Suitable, although less preferred compounds of this class are copolymers of acrylic acid or methacrylic acid with vinyl ethers, such as vinyl methyl ethers, vinyl esters, ethylene, propylene and styrene, in which the proportion of the acid is at least 50 wt. %. Terpolymers which contain, as monomers, two carboxylic acids and/or salts thereof and which contain, as third monomer, vinyl alcohol and/or a vinyl alcohol derivative or a carbohydrate can also be used as water-soluble organic builder substances. The first acid monomer or salt thereof derives from a monoethylenically unsaturated $C_3$-$C_8$ carboxylic acid and preferably from a $C_3$-$C_4$ monocarboxylic acid, in particular from (meth)acrylic acid. The second acid monomer or salt thereof can be a derivative of a $C_4$-$C_8$ dicarboxylic acid, wherein maleic acid is particularly preferred. The third monomer unit is in this case formed by vinyl alcohol and/or preferably an esterified vinyl alcohol. In particular, vinyl alcohol derivatives which constitute an ester formed of short-chain carboxylic acids, for example $C_1$-$C_4$ carboxylic acids, with vinyl alcohol are preferred. Preferred terpolymers here contain 60 wt. % to 95 wt. %, in particular 70 wt. % to 90 wt. % of (meth)acrylic acid and/or (meth) acrylate, particularly preferably acrylic acid and/or acrylate, and maleic acid and/or maleinate and also 5 wt. % to 40 wt. %, preferably 10 wt. % to 30 wt. % of vinyl alcohol and/or vinyl acetate. Here, terpolymers in which the ratio by weight of (meth)acrylic acid and/or (meth)acrylate to maleic acid and/or maleate is between 1:1 and 4:1, preferably between 2:1 and 3:1 and in particular 2:1 and 2.5:1 are very particularly preferred. Here, both the amounts and the ratios by weight are based on the acids. The second acid monomer or salt thereof can also be a derivative of an allylsulfonic acid which in the 2 position is substituted with an alkyl group, preferably with a $C_1$-$C_4$ alkyl group, or an aromatic group that derives preferably from benzene or benzene derivatives. Preferred terpolymers here contain 40 wt. % to 60 wt. %, in particular 45 to 55 wt. % of (meth)acrylic acid and/or (meth)acrylate, particularly preferably acrylic acid and/or acrylate, 10 wt. % to 30 wt. %, preferably 15 wt. % to 25 wt. % of methallylsulfonic acid and/or methallysulfonate, and, as third monomer, 15 wt. % to 40 wt. %, preferably 20 wt. % to 40 wt. % of a carbohydrate. This carbohydrate here can be a mono-, di-, oligo- or polysaccharide for example, wherein mono-, di- or oligosaccharides are preferred, with sucrose being particularly preferred. Due to the use of the third monomer, predetermined breaking points should be incorporated in the polymer and are responsible for the good biological degradability of the polymer. These terpolymers generally have a relative molecular mass between 1,000 g/mol and 200,000 g/mol, preferably between 2,000 g/mol and 50,000 g/mol, and in particular between 3,000 g/mol and 10,000 g/mol. They can be used in the form of aqueous solutions, preferably in the form of 30 to 50 wt. % aqueous solutions, in particular for the production of liquid products. All specified polycarboxylic acids are generally used in the form of their water-soluble salts, in particular their alkali salts.

Organic builder substances of this type are preferably contained in amounts of up to 40 wt. % in particular up to 25 wt. %, and particularly preferably from 1 wt. % to 5 wt. %. Amounts close to the specified upper limits are preferably used in pasty or liquid, in particular water-containing products.

In particular, crystalline or amorphous alkali aluminosilicates are used as water-insoluble, water-dispersible inorganic builder materials, in amounts of up to 50 wt. %, preferably not more than 40 wt. %, and in liquid products are used in particular from 1 wt. % to 5 wt. %. Among these, the crystalline aluminosilicates of detergent quality, in particular zeolite NaA and optionally NaX, are preferred. Amounts close to the specified upper limits are preferably used in solid, particulate products. Suitable aluminosilicates in particular have no particles having a particle size of more than 30 μm and preferably consist to an extent of at least 80 wt. % of particles having a size of less than 10 μm. Their calcium bonding capability lies in the range of from 100 to 200 mg of CaO per gram. Suitable substitutes or partial substitutes for the specified alumosilicate are crystalline alkali silicates, which can be present alone or mixed with amorphous silicates. The alkali silicates usable in the products as builder substances preferably have a molar ratio of alkali oxide to $SiO_2$ of less than 0.95, in particular from 1:1.1 to 1:12 and can be present in amorphous or crystalline form. Preferred alkali silicates are the sodium silicates, in particular the amorphous sodium silicates, with a molar ratio of $Na_2O:SiO_2$ of from 1:2 to 1:2.8. Such amorphous alkali silicates are commercially obtainable for example under the name Portil®. Those having a molar ratio of $Na_2O:SiO_2$ of from 1:1.9 to 1:2.8 are added preferably as a solid and not in the form of a solution within the scope of the production process. Crystalline sheet silicates of general formula $Na_2Si_xO_{2x-1}.yH_2O$, in which x, or what is known as the modulus, is a number from 1.9 to 4 and y is a number from 0 to 20 and preferred values for x are 2, 3 or 4, are preferably used as crystalline silicates, which can be present alone or mixed with amorphous silicates. Crystalline sheet silicates which fall under this general formula are described for example in European patent application EP 0164514. Preferred crystalline sheet silicates are those in which x in the specified general formula assumes the values 2 or 3. In particular, both β- and δ-sodium disilicates ($Na_2Si_2O_5.yH_2O$) are preferred. Practically anhydrous, crystalline alkali silicates of the above-mentioned general formula in which x means a number from 1.9 to 2.1 produced from amorphous alkali silicates can also be used in products which contain an active ingredient to be used in accordance with the invention. In a further preferred embodiment of products according to the invention, a crystalline sodium sheet silicate having a modulus of from 2 to 3 is used, as can be produced from sand and soda. Crystalline sodium silicates having a modulus ranging from 1.9 to 3.5 are used in a further preferred embodiment of detergents containing an active ingredient used in accordance with the invention. The content thereof of alkali silicates is preferably 1 wt. % to 50 wt. %, and in particular 5 wt. % to 35 wt. %, in relation to anhydrous active substance. If alkalialuminosilicate, in particular zeolite, is provided as additional builder substance, the content of alkali silicate is preferably 1 wt. % to 15 wt. % and in particular 2 wt. % to 8 wt. %, in relation to anhydrous active substance. The ratio by weight of alumosilicate to silicate, in each case in relation to anhydrous active substances, is then preferably 4:1 to 10:1. In products that contain both amorphous and crystalline alkalisilicates, the ratio by weight of amorphous alkalisilicate to crystalline alkalisilicate is preferably 1:2 to 2:1 and in particular 1:1 to 2:1.

In addition to the mentioned inorganic builder, further water-soluble or water-insoluble inorganic substances can be contained in the products that contain an active ingredient to be used in accordance with the invention, that are used together therewith, or that are used in methods according to the invention. In this context, the alkali carbonates, alkali hydrogen carbonates, and alkali sulfates and mixtures thereof are suitable. Additional inorganic material of this type can be provided in amounts up to 70 wt. %.

In addition, the products can contain further constituents that are conventional in detergents or cleaning products. These optional constituents include in particular enzymes, enzyme stabilizers, complexing agents for heavy metals, for example amino polycarboxylic acids, amino hydroxyl polycarboxylic acids, polyphosphonic acids and/or amino polyphosphonic acids, foam inhibitors, for example organopolysiloxanes or paraffins, solvents and optical brighteners, for example stilbene disulfonic acid derivatives. Optical brighteners, in particular compounds from the class of substituted 4,4'-bis-(2,4,6-triamino-s-triazinyl)-stilbene-2,2'-disulfonic acids, up to 5 wt. %, in particular 0.1 wt. % to 2 wt. %, of complexing agents for heavy metals, in particular amino-alkylene phosphonic acids and salts thereof, and up to 2 wt. %, in particular 0.1 wt. % to 1 wt. %, of foam inhibitors are preferably contained in products that contain an active ingredient used in accordance with the invention, wherein the specified proportions by weight relate in each case to total product.

In addition to water, solvents which in particular can be used in the case of liquid products are preferably those which can be mixed with water. These include the lower alcohols, for example ethanol, propanol, iso-propanol, and the isomeric butanols, glycerol, lower glycols, for example ethylene and propylene glycol, and the ethers derivable from the specified compound classes. The active ingredients used in accordance with the invention are generally present in such liquid products in dissolved or suspended form.

Enzymes, which are present optionally, are preferably selected from the group comprising proteases, amylases, lipases, cellulases, hemicellulases, oxidases, peroxidases, pectinases and mixtures thereof. Proteases obtained from microorganisms such as bacteria or fungi are primarily considered. They can be obtained from suitable microorganisms by fermentation processes, as is known. Proteases are commercially obtainable for example under the names BLAP®, Savinase®, Esperase®, Maxatase®, Optimase®, Alcalase®, Durazym® or Maxapem®. The usable lipases can be obtained for example from *Humicola lanuginosa*, from *Bacillus* types, from *Pseudomonas* types, from *Fusarium* types, from *Rhizopus* types, or from *Aspergillus* types. Suitable lipases are commercially obtainable for example under the names Lipolase®, Lipozym®, Lipomax®, Lipex®, Amano® lipase, Toyo-Jozo® lipase, Meito® lipase and Diosynth® lipase. Suitable amylases are commercially available for example under the names Maxamyl®, Termamyl®, Duramyl® and Purafect® OxAm. The usable cellulases can be an enzyme obtainable from bacteria or fungi, which enzyme has a pH optimum preferably in the weakly acidic to weakly alkaline range from 6 to 9.5. Cellulases of this type are commercially obtainable under the names Celluzyme®, Carezyme® and Ecostone®. Suitable pectinases are obtainable for example under the names Gamanase®, Pektinex AR®, X-Pect® or Pectaway® from Novozymes, under the name Rohapect UF®, Rohapect TPL®, Rohapect PTE100®, Rohapect MPE®, Rohapect MA plus HC, Rohapect DA12L®, Rohapect 10L®, Rohapect B1L® from AB Enzymes, and under the name Pyrolase® from *Diversa* Corp., San Diego, Calif., USA.

The conventional enzyme stabilizers optionally present, in particular in liquid products, include amino alcohols, for example mono-, di-, triethanol and -propanol amine and mixtures thereof, lower carboxylic acids, boric acid, alkali borates, boric acid-carboxylic acid combinations, boric acid esters, boric acid derivatives, calcium salts, for example Ca-formic acid combination, magnesium salts, and/or sulfur-containing reducing agents.

Suitable foam inhibitors include long-chain soaps, in particular behenic soaps, fatty acid amides, paraffins, waxes, microcrystalline waxes, organopolysiloxanes, and mixtures thereof, which additionally can contain micro-fine, optionally silanized or otherwise waterproofed silica. Foam inhibitors of this type are preferably bound to granular, water-soluble carrier substances for use in particulate products.

The known polyester-active polymers capable of removing dirt, which can be used in addition to the active ingredients essential to the invention, include copolyesters of dicarboxylic acids, for example adipic acid, phthalic acid or terephthalic acid, diols, for example ethylene glycol or propylene glycol, and polydiols, for example polyethylene glycol or propylene glycol. The polyesters capable of removing dirt that are used with preference include compounds which are formally accessible by esterification of two monomer parts, wherein the first monomer is a dicarboxylic acid HOOC-Ph-COOH and the second monomer is a diol $HO—(CHR^{11}—)_aOH$, which can also be present in the form of a polymeric diol $H—(O—(CHR^{11}—)_a)_bOH$. Therein, Ph means an o-, m- or p-phenyl group, which can carry 1 to 4 substituents, selected from alkyl groups having 1 to 22 C atoms, sulfonic acid groups, carboxyl groups, and mixtures thereof, $R^{11}$ is hydrogen, an alkyl group having 1 to 22 C atoms and mixtures thereof, a is a number from 2 to 6, and b is a number from 1 to 300. In the polyesters obtainable therefrom, there are preferably present both monomer diol units $—O—(CHR^{11}—)_aO—$ and polymer diol units $—(O—(CHR^{11}—)_a)_bO—$. The molar ratio of monomer diol units to polymer diol units is preferably 100:1 to 1:100, in particular 10:1 to 1:10. In the polymer diol units, the degree of polymerization b preferably lies in a range of from 4 to 200, in particular from 12 to 140. The molecular weight or the mean molecular weight or the maximum of the molecular weight distribution of preferred polyesters capable of removing dirt lies in a range of from 250 g/mol to 100,000 g/mol, in particular from 500 g/mol to 50,000 g/mol. The acid forming the basis of the group Ph is preferably selected from terephthalic acid, isophthalic acid, phthalic acid, trimellitic acid, mellitic acid, the isomers of sulfophthalic acid, sulfoisophthalic acid, and sulfoterephthalic acid and mixtures thereof. Provided the acid groups thereof are not part of the ester bonds in the polymer, they are preferably present in salt form, in particular as alkali salt or ammonium salt. Among these, the sodium and potassium salts are particularly preferred. If desired, small proportions, in particular no more than 10 mol % in relation to the proportion of Ph with the above-mentioned meaning, of other acids comprising at least two carboxyl groups, can be contained in the polyester capable of removing dirt instead of the monomer HOOC-Ph-COOH. These other acids for example include alkylene and alkenyl dicarboxylic acids, such as malonic acid, succinic acid, fumaric acid, maleic acid, glutaric acid, adipic acid, pimelic acid, suberic acid, azelaic acid, and sebacic acid. The preferred diols $HO—(CHR^{11}—)_aOH$ include those in which $R^{11}$ is hydrogen and a is a number from 2 to 6, and those in which a has the value 2 and $R^{11}$ is selected from hydrogen and the alkyl groups having 1 to 10, in particular 1 to 3 C atoms. Among the last-mentioned diols, those of formula $HO—CH_2—CHR^{11}—OH$, in which $R^{11}$ has the above-mentioned meaning, are particularly preferred. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. Among the polymeric diols, polyethylene glycol having a mean molar mass ranging from 1,000 g/mol to 6,000 g/mol is particularly preferred.

If desired, these polyesters composed as described above can also be end-group-terminated, wherein alkyl groups having 1 to 22 C atoms and esters of monocarboxylic acids are potential end groups. The end groups bound via ester bonds can be based on alkyl, alkenyl and aryl monocarboxylic acids having 5 to 32 C atoms, in particular 5 to 18 C atoms. These include valeric acid, caproic acid, enanthic acid, caprylic acid, pelargonic acid, capric acid, undecanoic acid, undecylenic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, elaostearic acid, arachinic acid, gadoleic acid, arachidonic acid, behenic acid, erucic acid, brasidinic acid, clupanodonic acid, lignoceric acid, cerotic acid, melissic acid, benzoic acid, which can carry 1 to 5 substituents with a total of up to 25 C atoms, in particular 1 to 12 C atoms, for example tert.-butylbenzoic acid. The end groups can also be based on hydroxymonocarboxylic acids having 5 to 22 C atoms, including for example hydroxyvaleric acid, hydroxycaproic acid, ricolinic acid, the hydrogenation product thereof hydroxystearic acid, and o-, m- and p-hydroxybenzoic acid. The hydroxymonocarbxylic acids can in turn be bound to one another via their hydroxyl group and their carboxyl group and thus can be present multiple times in an end group. The number of hydroxymonocarboxylic acid units per end group, i.e. their degree of oligomerization, preferably lies in the range of from 1 to 50, in particular from 1 to 10. In a preferred embodiment of the invention, polymers formed of ethylene terephthalate and polyethylene oxide terephthalate, in which the polyethylene glycol units have molecular weights of from 750 g/mol to 5,000 g/mol and the molar ratio of ethylene terephthalate to polyethylene oxide terephthalate is 50:50 to 90:10, are used in combination with an active ingredient essential to the invention.

The polymers capable of removing dirt are preferably water-soluble, wherein the term "water-soluble" is to be understood to mean a solubility of at least 0.01 g, preferably at least 0.1 g of the polymer per liter of water at room temperature and pH 8. Used polymers, however, under these conditions preferably have a solubility of at least 1 g per liter, in particular at least 10 g per liter.

The production of solid products according to the invention does not provide any difficulties and can be performed in the known manner, for example by spray drying or granulation, wherein enzymes and possible further thermally sensitive ingredients such as bleaching agents can be added separately later as appropriate. In order to produce products according to the invention of increased bulk weight, in particular ranging from 650 g/l to 950 g/l, a method comprising an extrusion step is preferred.

In order to produce products according to the invention in tablet form which can be monophase or multi-phase, which can be one or more colors, and which in particular can consist of a layer or of a number of layers, in particular two layers, an approach is preferably adopted in which all constituents (of each layer as appropriate) are mixed with one another in a mixer and the mixture is compacted by means of conventional tablet presses, for example eccentric presses or rotary presses, with pressing forces ranging from approximately 50 to 100 kN, preferably at 60 to 70 kN. In particular in the case of multi-layered tablets, it may be advantageous if at least one layer is pre-compacted. This is preferably carried out at pressing forces between 5 and 20 kN, in particular at 10 to 15 kN. Break-resistant tablets, which nevertheless are sufficiently quickly soluble under usage conditions and which have breaking and bending strengths of normally 100 to 200 N, but preferably above 150 N, are thus obtained without difficulty. A tablet produced in this way preferably has a weight of from 10 g to 50 g, in particular from 15 g to 40 g. The physical form of the tablets is arbitrary and can be round, oval or polygonal, wherein intermediate forms are also possible. Corners and edges are advantageously rounded. Round tablets preferably have a diameter of from 30 mm to 40 mm. In particular, the size of polygonal or cuboidal tablets, which for example are introduced to the dishwasher primarily via the dosing device, is dependent on the geometry and the volume of this dosing device. Exemplary preferred embodiments have a base area of (20 to 30 mm)×(34 to 40 mm), in particular of 26×36 mm or of 24×38 mm.

Liquid or pasty products according to the invention in the form of solutions containing conventional solvents, in particular water, are generally produced by simply mixing the ingredients that can be introduced into an automatic mixer in the form of a substance or as a solution.

In a preferred embodiment a product in which the active ingredient to be used in accordance with the invention is incorporated is liquid and contains 1 wt. % to 15 wt. %, in particular 2 wt. % to 10 wt. % of non-ionic surfactant, 2 wt. % to 30 wt. %, in particular 5 wt. % to 20 wt. % of synthetic anionic surfactant, up to 15 wt. %, in particular 2 wt. % to 12.5 wt. % of soap, 0.5 wt. % to 5 wt. %, in particular 1 wt. % to 4 wt. % of organic builder, in particular polycarboxylate such as citrate, up to 1.5 wt. %, in particular 0.1 wt. % to 1 wt. % of complexing agent for heavy metals, such as phosphonate, and additionally optionally contained enzyme, enzyme stabilizer, dye and/or fragrance, water and/or water-miscible solvent.

In a further preferred embodiment a product in which the active ingredient to be used in accordance with the invention is incorporated is provided in the form of particles and contains up to 25 wt. %, in particular 5 wt. % to 20 wt. % of bleaching agent, in particular alkali percarbonate, up to 15 wt. %, in particular 1 wt. % to 10 wt. % of bleach activator, 20 wt. % to 55 wt. % of inorganic builder, up to 10 wt. %, in particular 2 wt. % to 8 wt. % of water-soluble organic builder, 10 wt. % to 25 wt. % of synthetic anionic surfactant, 1 wt. % to 5 wt. % of non-ionic surfactant, and up to 25 wt. %, in particular 0.1 wt. % to 25 wt. % of inorganic salts, in particular alkali carbonate and/or alkali hydrogen carbonate.

EXAMPLES

Example 1: Production of poly(N-vinyl-2-pyrrolidone-co-1-vinyl-3-(1-carboxymethyl)-imidazolium betaine)

N-vinyl-2-pyrrolidone and 1-vinyl imidazole were purified by distillation under vacuum prior to use (N-vinyl-2-pyrrolidone: 3-4 mbar, 100° C. oil bath, 77-83° C. head temperature, vacuum jacketed distillation; 1-vinyl imidazole: 12 mbar, 90° C. oil bath, 70° C. head temperature, vacuum jacketed distillation). The amount of 1-vinyl imidazole specified in Table 1, the amount of N-vinyl-2-pyrrolidone specified in Table 1, and 250 ml methanol were weighed into a 500 ml Schlenk flask and flushed through with nitrogen for 25 minutes. Next, 15 mg of azobisisobutyronitrile were then added to the batches provided for the production of lower-molecular polymers V1 and V3 and the batches provided for the production of higher-molecular polymers V2 and V4, and said batches were flushed for a further 25 minutes with nitrogen, then the batches were stirred for 48 h at 60° C. The same amount of azobisisobutyronitrile was then added again after this time to the batches provided for the production of high-molecular polymers V2 and V4, and again after a total of 72 hours, and the batches were each again flushed with nitrogen, and the polymerization was continued at 60° C. up to a total time of 96 hours.

After removal of the solvent on a rotary evaporator, the residue was dissolved in water and then freeze-dried.

The polymeric intermediate products thus obtained were dissolved in 80 ml dimethylacetamide at 75° C., 10 ml bromacetic acid tert-butyl ester were added, and the reaction mixture was stirred at 75° C. for 48 h. The precipitate precipitated as a result of the addition of 600 ml diethylether was then suctioned off using a Schlenk-frit under nitrogen, washed in each case with 100 ml diethylether and dried in the nitrogen flow.

To remove the tert-butyl protection groups, the intermediate product thus obtained was mixed with 30 ml trifluoroacetic acid and stirred for 24 hours at room temperature. Once the trifluoroacetic acid had condensed off, the polymers were dissolved in water and isolated by freeze-drying.

The following variants of poly(N-vinyl-2-pyrrolidone-co-1-vinyl-3-(1-carboxymethyl)-imidazolium betaines) having the mean molar masses and molar ratios of imidazolium betaine to vinylpyrrolidone specified in Table 1 for the resultant polymers were thus synthesized:

| Polymer | Amount of 1-vinyl imidazole | Amount of N-vinyl-2-pyrrolidone | Molar mass | Molar ratio |
|---|---|---|---|---|
| V1 | 36 g | 14 g | 5,000 g/mol | 50:50 |
| V2 | 36 g | 14 g | 5,000 g/mol | 50:50 |
| V3 | 11 g | 39 g | 5,000 g/mol | 75:25 |
| V4 | 11 g | 39 g | 5,000 g/mol | 75:25 |

Example 2

Detergent compositions (values in wt. %)

| | A | B | C | D | E | F | G | H |
|---|---|---|---|---|---|---|---|---|
| $C_{9-13}$ alkylbenzene sulfonate, Na salt | 9 | 10 | 6 | 7 | 5 | 15 | 15 | 9 |
| $C_{12-18}$ fatty alcohol with 7 EO | 8 | 9 | 6 | 7 | 5 | 6 | 11 | 10 |
| $C_{12-14}$ fatty alcohol sulfate with 2 EO | — | — | 8 | 7 | 10 | 2 | 2 | 5 |
| $C_{12-18}$ fatty acid, Na salt | 4 | 3 | 3 | 3 | 4 | 2 | 4 | 7 |
| Citric acid | 2 | 3 | 3 | 2 | 2 | 2 | 2 | 3 |
| Sodium hydroxide, 50% | 3 | 3 | 2 | 3 | 3 | 3 | 3 | 4 |
| Boric acid | 1 | 1 | 1 | 1 | 1 | 1 | 1 | 1 |
| Enzymes (amylases, proteases, cellulases) | + | + | + | + | + | + | + | + |
| Perfume | 1 | 0.5 | 0.5 | 1 | 1 | 1 | 1 | 1 |
| Glycerol | 3 | 2 | 2 | 2 | 2 | — | — | 2 |
| Propanediol | — | — | — | — | — | 5 | 5 | — |
| Ethanol | 1.5 | 1.5 | 1.5 | 1.5 | 1.5 | 1.5 | 1. | 5 |
| PVA/maleic acid copolymer | 0.1 | — | 0.1 | — | — | — | — | — |
| Optical brightener | — | 0.1 | — | 0.1 | 0.2 | 0.2 | 0.2 | 0.2 |
| Alkylaminophosphonic acid | 0.5 | 0.5 | 0.5 | 0.5 | 0.5 | 0.5 | 0.5 | 0.5 |
| Polymer essential to the invention | 2 | 2 | 2 | 2 | 2 | 2 | 2 | 2 |
| Water | to 100 | | | | | | | |

Example 3: Washing Tests

Test textiles made of cotton and provided with standardized soiling (A: C-S-46b, used frying fat; B: C-01, soot/mineral oil; C: C-03, chocolate milk/soot; all obtainable from the Center for Test Materials BV) were washed at 25° C. using the detergent C as specified in Example 2 comprising a polymer V1 to V4 produced as specified in Example 1 with a dosing of the detergent of 4.2 g/l for 1 hour. Once rinsed with water and hung to dry, the degree of whiteness of the test textiles was determined by spectrophotometry (Minolta® CR400-1). The differences of the remission values (in each case in %) with the same use of the detergent without polymer essential to the invention (but otherwise of identical composition) are specified in the following Table 3 as mean values from 5 measurements.

TABLE 3

Washing results (remission difference)

| | polymer | | | |
|---|---|---|---|---|
| Dirt | V1 | V2 | V3 | V4 |
| A | 1.2 | n.d. | 3.3 | 2.2 |
| B | 1.0 | 0.8 | 2.3 | 0.6 |
| C | 2.3 | 1.8 | 2.3 | 1.5 |

n.d.: not determined

The detergents comprising the active ingredients to be used in accordance with the invention demonstrated a much better primary washing power than a product devoid of said active ingredients, but otherwise of identical composition.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A detergent or cleaning product, comprising a polymer formed of the units A and B,

A

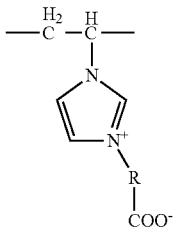

B

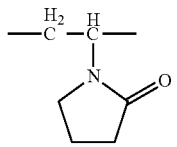

wherein R stands for a double-bond hydrocarbon group having 1 to 6 carbon atoms, and alkylbenzene sulfonate with linear $C_{7-15}$ alkyl groups.

2. The product according to claim 1, wherein the ratio by weight of alkylbenzene sulfonate to polymer formed of the units A and B lies in a range of from 20:1 to 1:1.

3. A method for removing soiling from textiles or hard surfaces by contacting the textile or the hard surface with an aqueous liquor, comprising a detergent or cleaning product and a polymer formed of the units A and B,

A

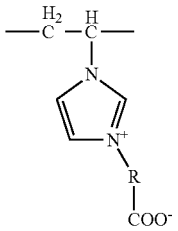

B

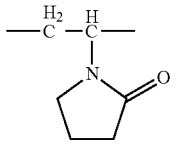

wherein R stands for a double-bond hydrocarbon group having 1 to 6, and alkylbenzene sulfonate with linear $C_{7-15}$ alkyl groups.

* * * * *